United States Patent [19]

Baugh

[11] Patent Number: 4,491,177

[45] Date of Patent: Jan. 1, 1985

[54] BALL DROPPING ASSEMBLY

[75] Inventor: John L. Baugh, Huntsville, Tex.

[73] Assignee: Hughes Tool Company, Houston, Tex.

[21] Appl. No.: 395,175

[22] Filed: Jul. 6, 1982

[51] Int. Cl.[3] ..... E21B 23/00

[52] U.S. Cl. ..... 166/75 R; 166/193; 166/72; 166/381; 137/268

[58] Field of Search ..... 175/54, 75R; 166/70, 166/72, 193, 194, 381, 386; 15/104.06 A; 221/75; 137/268

[56] References Cited

U.S. PATENT DOCUMENTS

| | | | |
|---|---|---|---|
| 2,866,213 | 12/1958 | McArthur et al. | 15/104.06 A |
| 3,715,055 | 2/1973 | Kendrick et al. | 221/75 |
| 4,073,303 | 2/1978 | Foley | 15/104.06 A |
| 4,211,279 | 7/1980 | Isaacks | 166/70 |

*Primary Examiner*—Stephen J. Novosad

*Assistant Examiner*—Mark J. DelSignore

*Attorney, Agent, or Firm*—Robert A. Felsman; Charles D. Gunter, Jr.

[57] ABSTRACT

A ball dropping assembly is shown of the type which is connected in a string of pipe for dropping a ball in the pipe string. A main body is mounted on the pipe. The main body has an interior bore which communicates with the interior of the pipe. A cam housing is received within the main body bore and has a ball receiving recess formed in the interior thereof. A ball dropping can is rotatably received within the cam housing. The can has partially cut-away sidewalls which form a camming surface for the ball. A retaining nut engages and seals the cam housing and can within the body whereby rotation of the can with respect to the cam housing houses the camming surface to contact the ball to thereby eject the ball from the ball receiving recess into the interior of the pipe without opening the assembly to the atmosphere.

2 Claims, 6 Drawing Figures

FIG. 5
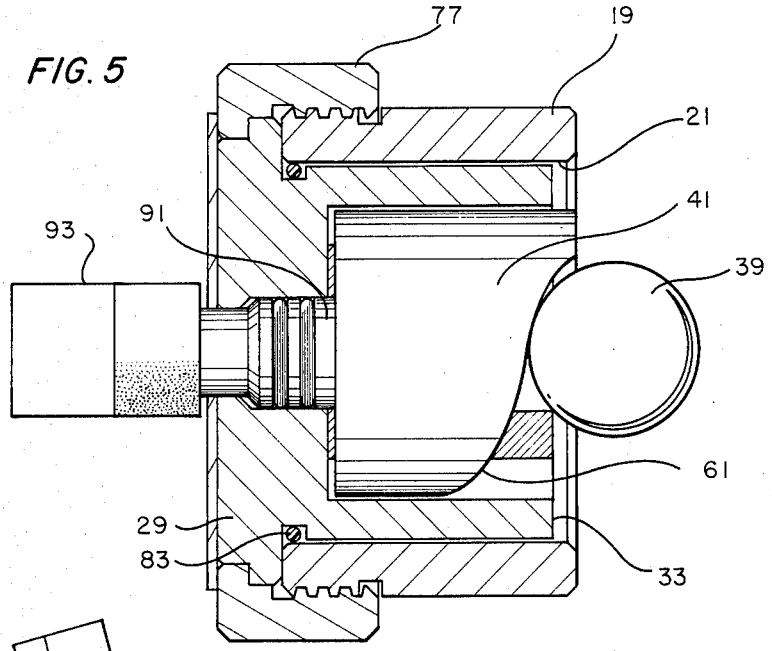
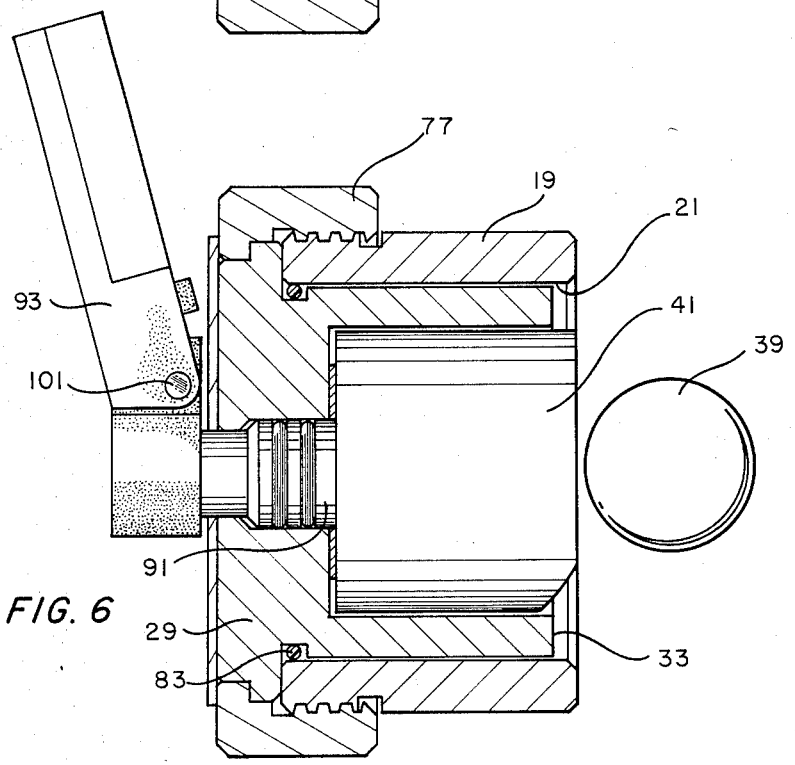
FIG. 6

BALL DROPPING ASSEMBLY

BACKGROUND OF THE INVENTION

The present invention relates generally to well tools of the type used in drilling, completing and workover of oil and gas wells and specifically to a well tool of the type which can be operated to eject a ball into a pipe string without opening the pipe string to the atmosphere.

At times during well drilling, completion, and workover activities, it becomes desirable to drop a ball into the pipe string. Any of a number of purposes may be served by dropping a ball into the pipe string. For instance, the ball can be dropped at the surface to be caught in a ball catching sub located further down the pipe string within the well bore. The then sealed-off conduit can be pressured up from the surface to provide hydraulic actuation for gripping and sealing elements carried on the pipe string. Balls are also used in cementing operations to divert the flow of cement where staged cementing operations are employed. The ball can also be dropped to allow a pin to be sheared as a part of the operating procedure for a given well tool.

A variety of devices are shown in the prior art for dropping one or more balls into a fluid conduit to clean the interior surfaces of a production pipe line. Other known devices allow a plurality of balls to be introduced into the stream of treating fluid being pumped down the well, such as during perforation sealing operations. Devices have also been provided on pipe strings for injecting one or more balls into the string to act as well safety valves. Such devices provided ball release in response to hazardous conditions such as fire. Each of the above mentioned devices were complicated in design and involved a multitude of intricately machined parts, springs, valves, and the like. Such devices were not well suited for the purpose of insertion in the pipe string above the rig floor for injecting a single ball into the well string.

As a result, in the past when it was desired to drop a single large diameter ball into the pipe string to be caught in a ball dropping sub, or the like, the pipe string joint at the rig floor was broken out and a ball was manually inserted in the pipe string. The pipe string joint was then again made up and work continued. The disadvantage of such a technique was the wasted time involved in breaking out and making up the pipe joint. Also, if fluids were being run through the pipe string under pressure, operations were shut down while the joint was broken out.

There has existed a need, therefore, for a simple device for insertion in a string of pipe which could be operated at the rig floor to drop a ball into the pipe string without the necessity of opening the assembly to the atmosphere.

SUMMARY OF THE INVENTION

The present ball dropping assembly for connection in a string of pipe has a main body mounted on the pipe having an interior bore which communicates with the interior of the pipe. A cam housing is received within the main body bore. The housing has a ball receiving recess formed in the interior thereof. A ball dropping can is rotatably received within the cam housing. The can has partially cut-away sidewalls and the cut-away sidewalls form a camming surface for the ball. Retaining means engage and seal the cam housing and can within the body. Rotation of the can with respect to the cam housing causes the camming surface to contact the ball to thereby eject the ball from the ball receiving recess into the interior of the pipe without opening the assembly to the atmosphere.

Preferably, the main body is a cylindrically shaped member adapted to be inserted in an opening formed in the pipe normal to the longitudinal axis of the pipe. The cam housing has outer cylindrical sidewalls which are received within the main body bore. The housing has a closed end with a shaft receiving opening, an open end for communicating with the pipe interior bore, and tapered interior sidewalls which form the ball receiving recess for receiving a ball. The ball dropping can preferably has a partially cut-away bottom, partially cut-away sidewalls which allow a portion of the ball in the ball receiving recess to be contained in the can, and a rigid shaft which extends from the bottom of the can through the can interior and outwardly therefrom.

A threaded nut having an internally threaded surface engages a mating surface on the exterior of the main body to engage the cam housing and can within the main body with the can shaft extending through the opening in the cam housing closed end. Rotation of the shaft rotates the can with respect to the cam housing to eject a ball from the ball receiving recess into the interior of the pipe. Ball positioning means can be provided inside the ball dropping can which cooperate with the ball receiving recess to restrict circumferential movement of the ball about the shaft in the can while allowing axial movement of the ball along the axis of the main body interior bore. The ball positioning means can comprise a cylindrical fitting having an internal bore for receiving the can shaft and a side opening for receiving a portion of the ball.

Additional objects, features, and advantages will be apparent in the description which follows.

BRIEF DESCRIPTION OF THE DRAWINGS

FIG. 5 is a side, partially broken away, perspective view of the assembly of FIG. 1 showing the ball partly ejected from ball receiving recess.

FIG. 6 is a side, partially broken away, perspective view of the assembly of FIG. 1 showing the ball fully ejected into the pipe string.

DETAILED DESCRIPTION OF THE INVENTION

Figure 1:
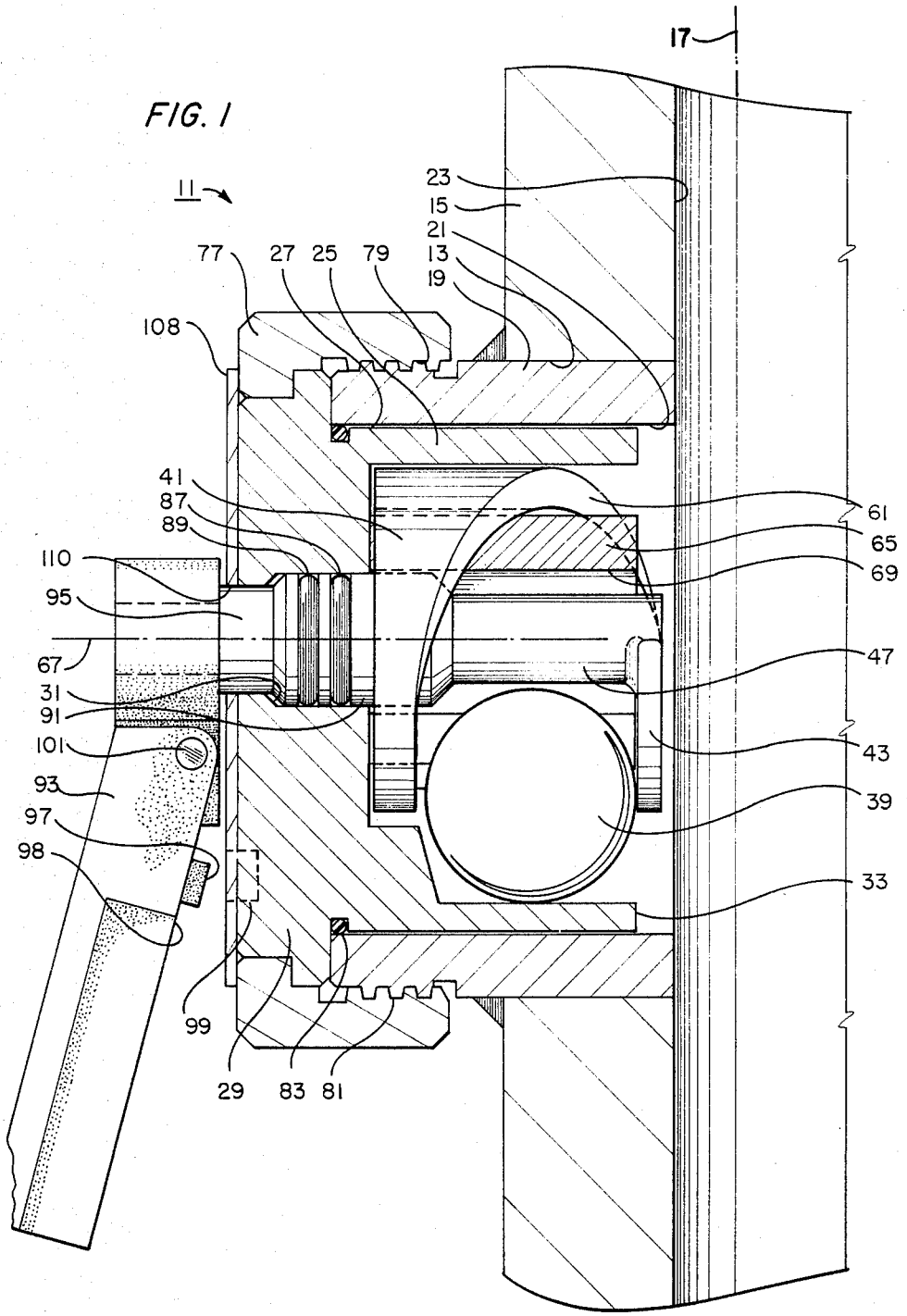
FIG. 1 is a side, partially broken away, perspective view of the assembly of FIG. 1 with a ball in place.

Turning now to FIG. 1, there is shown a ball dropping assembly designated generally as 11. The assembly 11 is shown inserted in an opening 13 in a well pipe sub 15. Assembly 11 is arranged generally normal to the longitudinal axis 17 of the pipe sub 15.

Figure 2:
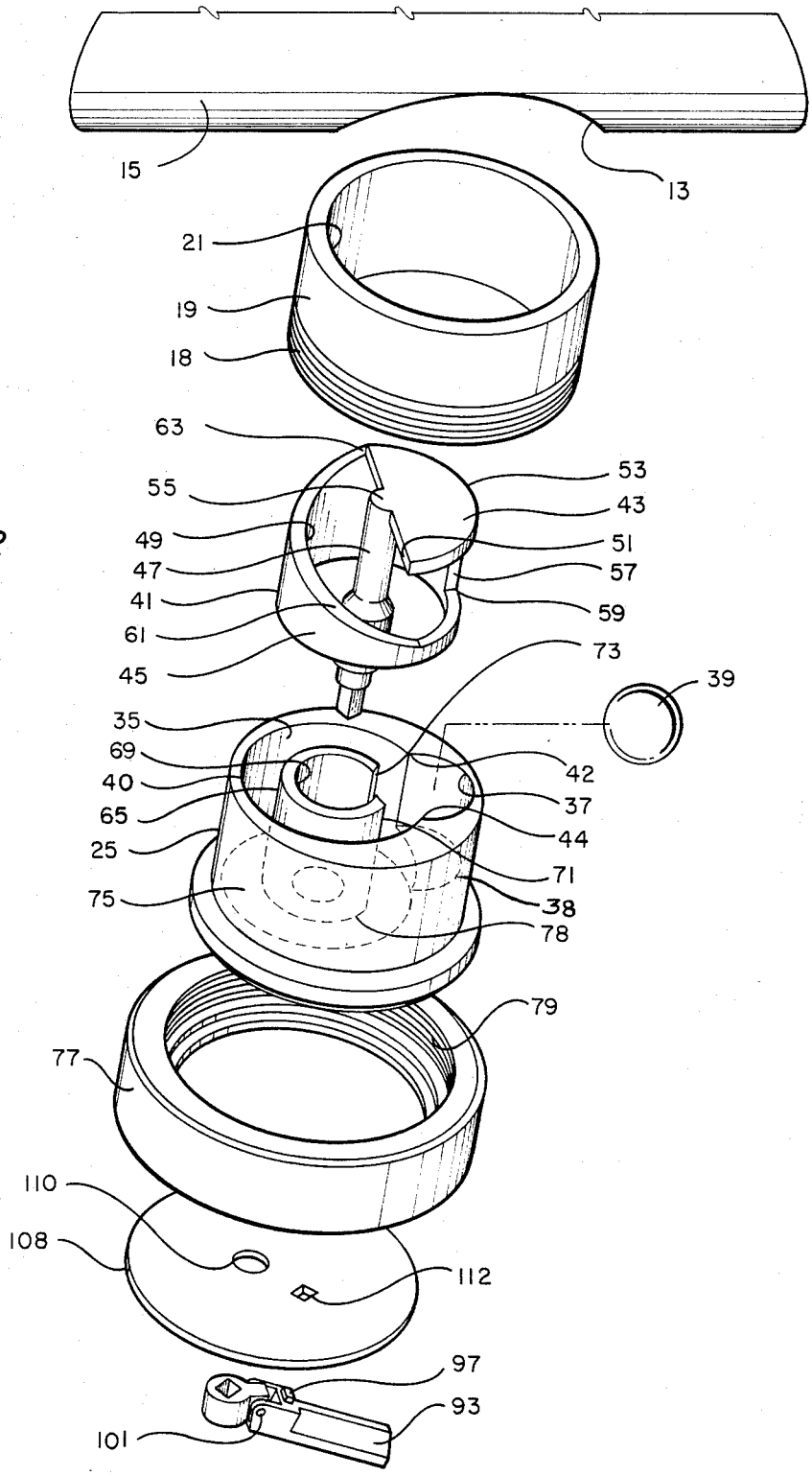
FIG. 2 is an exploded perspective view of the ball dropping assembly of the invention.

Assembly 11 includes a main cylindrical body 19 mounted on a pipe sub 15 and having an interior bore 21 which communicates with the interior 23 of pipe sub 15. Although assembly 11 is shown inserted in an opening 13 in well pipe sub 15, the assembly 11 could as easily be mounted on the exterior of the pipe sub 15 as long as an opening was provided in the pipe sub which communicated with interior bore 21. A cam housing 25 having a closed end 29, an open end 33, and outer cylindrical sidewalls 27 is received within the main body bore 21. Cam housing closed end 29 has a shaft receiving opening 31. Open end 33 of cam housing 25 communicates with the pipe interior bore 23. As best seen in FIG. 2, cam housing 25 has tapered interior sidewalls 35 with a ball receiving recess 37 formed therein for receiving a single ball 39. Sidewalls 35 are tapered such that the thickness of the sidewalls 35 gradually increases from a minimum point 40 outwardly to oppositely facing maximum points 42, 44 on opposite sides of recess 37. A stepped ledge 38 in recess 37 contacts the ball 39 when the ball is in place within the assembly.

A ball dropping can 41 is rotatably received within cam housing 25. As shown in FIG. 2, can 41 has a partially cut-away bottom 43, partially cut-away sidewalls 45, and a rigid shaft 47 extending from bottom 43 through the interior 49 of can 41 and outwardly therefrom. Cut-away bottom 43, as shown in FIG. 2, has a straight outer edge 51 which is joined at either end thereof by a semi-circular outer peripheral edge 53. Shaft 47 is fixedly attached to bottom 43 at a point 55 at the approximate mid-point of straight edge 51 as by welding or the like. Cut-away sidewalls 45 are suitably formed to provide a depending sidewall 57 which extends downwardly at a generally right angle to bottom 43 to a point 59 which in turn is connected to the bottom 43 at a point 63. The resulting partially cut-away sidewalls 45 allow a portion of the ball 39 which is partly contained in ball receiving recess 37 of cam housing 25 to be contained in the interior 49 of can 41. Tapered surface 61 forms a camming surface with respect to ball 39, as will be more fully described in the operational description of the invention.

As seen in FIGS. 1 and 2, a ball positioning means, including a U-shaped cylindrical fitting 65 can be provided within cam housing 25 which cooperates with ball receiving recess 37 to restrict circumferential movement of ball 39 about shaft 47 in the interior 49 of can 41 while allowing axial movement of ball 39 parallel to the longitudinal axis 67 of shaft 47. Fitting 65 has an internal bore 69 for receiving shaft 47 and an opening 71 in the sidewalls thereof for receiving a portion of ball 39. The exposed edges 73 of the opening 71 are suitably tapered to accommodate the outer spherical surface of ball 39 (see FIG. 2). Fitting 65 can be an integral part of the bottom interior surface 75 of cam housing 25 or can be connected to the surface 75 in any convenient manner, as by welding, with opening 71 facing the ball receiving recess 37 in cam housing 25. If desired, fitting 65 can be removably connected to surface 75 as by a pair of connecting pins (not shown) placed in complimentary bores in the bottom surface 78 of fitting 65 and in surface 75.

As shown in FIG. 1, cam housing 25 and ball dropping can 41 are maintained in position inside main body 19 by means of an outer threaded nut 77 having an internally threaded surface 79 adapted to engage a mating externally threaded surface 81 on the exterior of main body 19. An O-ring seal 83 which circumscribes the outer sidewalls 27 of cam housing 25 adjacent closed end 29 provides a seal with the interior surface 21 of main body 19. A pair of O-ring seals 87, 89 on an enlarged portion 91 of shaft 47 are received within an opening 31 in closed end 29 of cam housing 25 and seal opening 31 to the atmosphere. Threaded nut 77 thus comprises retaining means for engaging and sealing cam housing 25 and can 41 within main body 19 whereby rotation of can 41 with respect to cam housing 25 causes camming surface 61 to contact ball 39 to thereby eject ball 39 from ball receiving recess 37 into the interior 23 of pipe 15 without opening assembly 11 or the pipe string to the atmosphere.

Rotation of can 41 with respect to cam housing 25 can conveniently be provided by a handle 93 connected to the end 95 of shaft 47 opposite bottom 43, handle 93 being located on the exterior of the sealed assembly 11. Handle 93 can be temporarily fixed in a given position by a tab 97 on the bottom surface 98 of handle 93 which is received within a slot 99 in closed end 29. As shown in FIG. 1, handle 93 can be provided with a pivotable connection such as pin 101 whereby tab 97 can be moved into and out of locking engagement with slot 99. An outer circular plate 108 having an opening 110 can be placed over closed end 29 with shaft 47 passing through opening 110. Opening 112 in plate 108 is provided to receive tab 97.

Figure 3:
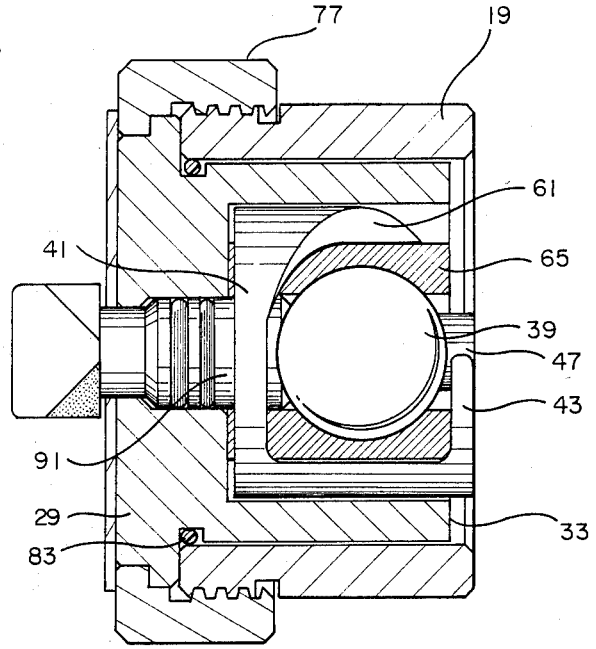
FIG. 3 is a side, partially cut away, perspective view of the assembly of FIG. 1 showing the ball in the loaded position.

The operation of the ball dropping assembly will now be described in greater detail. Main body 19 is first fixedly mounted onto pipe 15 so that interior bore 21 of body 19 communicates with the interior 23 of pipe sub 15 as shown in FIG. 1. (The assembly is shown in isolated fashion in FIG'S. 3-6 for simplicity). The ball dropping can 41 is then positioned within cam housing 25 with shaft 47 passing through bore 69 of fitting 65 and opening 31 in closed end 29 and with bottom 43 located adjacent open end 33 of housing 25. Handle 93 can then be attached to end 95 of shaft 47. By rotating handle 93, bottom 43 of can 41 is rotated, thereby allowing a single ball 39 to be inserted in the ball receiving recess 37 of cam housing 25. Continued rotation of handle 93 allows ball 39 to ride down camming surface 61 of sidewall 45 to the fully seated position shown in FIGS. 1 and 3. As best seen in FIG. 3, when in the fully loaded position, bottom 43 prevents ball 39 from rolling out of the ball receiving recess 37 into the pipe interior 23. The assembly with a ball in the fully loaded position is then inserted into the main body 19 and nut 77 is engaged to seal the assembly 11 to the atmosphere. Circular plate 108 can be placed over the exterior surface of closed end 29 by passing shaft 47 through opening 110 and reattaching handle 93.

Figure 4:
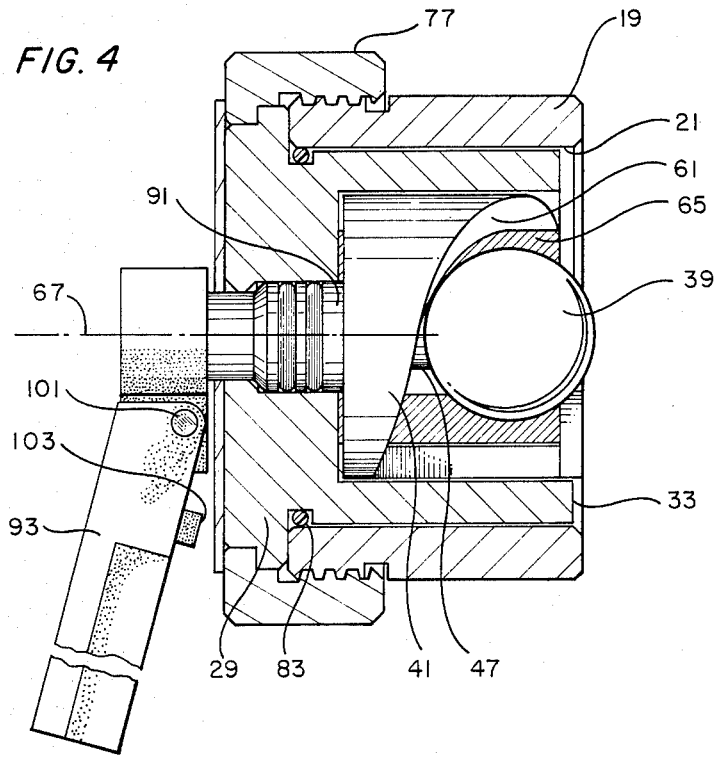
FIG. 4 is a side, partially broken away, perspective view of the assembly of FIG. 1 showing the beginning of the ball injection cycle.

FIG. 3 shows the ball 39 in the fully loaded position prior to rotating handle 93. As long as tab 103 is seated in slot 99, the handle will be fixed in the fully loaded position. When it is desired to eject ball 39 into the pipe string, handle 93 is pivoted about pin 101 to remove tab 103 from slot 99 and allow rotation of the handle 93 about the axis 67 of shaft 47. Handle 93 is then rotated in the clockwise direction when looking down on closed end 29 to cause camming surface 61 to contact ball 39 (see FIG. 4). As handle 93 is rotated further, ball 39 rides down camming surface 61 (see FIG'S. 5 and 6) and is ejected into the pipe interior 23.

It is possible to check to see if the ball is fully ejected into the pipe by rotating handle 93 180 degrees in the counter-clockwise direction when looking down on closed end 29. If the ball 39 is present in recess 37, sidewall 57 of the ball dropping can 41 contacts the ball 39 and further movement is impossible since the ball is trapped between sidewall 57 and the ball receiving recess 37. If the ball has been fully ejected, 180 degree movement of handle 93 is possible.

An invention has been provided with significant advantages. The present ball dropping assembly allows a ball to be dropped into the pipe string without the necessity of breaking out a tool joint in the pipe string. Since the ball dropping assembly is sealed to the atmosphere, a ball can be dropped into the pipe string without the interruption of drilling, completion, or testing activities which would result from a ball dropping assembly which was open to the atmosphere. The retaining means can be removed to insert a new ball to allow the ball dropping assembly to be reused if necessary. The ball dropping assembly is simple in design and operation and eliminates complicated valving and intricately machined parts. The assembly operation allows positive checks to insure that the ball has been fully ejected into the pipe string by simply rotating the handle 180 degrees.

While the invention has been shown in only one of its forms, it should be apparent that it is not thus limited but is susceptible to various changes and modifications without departing from the spirit thereof.

I claim:

1. A ball dropping assembly for connection in a string of pipe, comprising:

a main cylindrical body mounted on said body having an interior bore which communicates with the interior of said pipe;

a cam housing received within said main body bore, said housing having a closed end with a shaft receiving opening, an open end for communicating with the pipe interior bore, and tapered interior sidewalls having a ball receiving recess formed therein for receiving a ball;

a ball dropping can rotatably received within said cam housing, said can having a partially cut-away bottom, partially cut-away sidewalls which allow a portion of said ball in said ball receiving recess to be contained in said can, said cut-away sidewalls forming a camming surface for said ball, and a rigid shaft extending from said bottom through the interior of said can and outwardly therefrom;

retaining means for engaging said cam housing and can within said main body with said can shaft extending through said opening in said cam housing closed end, whereby rotation of said shaft rotates said can with respect to said cam housing to eject a ball from said ball receiving recess into the interior of said pipe without opening said assembly to the atmosphere; and ball positioning means inside said ball dropping can which cooperate with said ball receiving recess to restrict circumferential movement of said ball about said shaft in said can while allowing axial movement of said ball parallel to the longitudinal axis of said shaft.

2. A ball dropping assembly for connection in a string of pipe, comprising;

a main cylindrical body mounted on said body having an interior bore which communicates with the interior of said pipe;

a cam housing received within said main body bore, said housing having a closed end with a shaft receiving opening, an open end for communicating with the pipe interior bore, and tapered interior sidewalls having a ball receiving recess formed therein for receiving a ball;

a ball dropping can rotatably received within said cam housing, said can having a partially cut-away bottom, partially cut-away sidewalls which allow a portion of said ball in said ball receiving recess to be contained in said can, said cut-away sidewalls forming a camming surface for said ball, and a rigid shaft extending from said bottom through the interior of said can and outwardly therefrom;

retaining means for engaging said cam housing and can within said main body with said can shaft extending through said opening in said cam housing closed end, whereby rotation of said shaft rotates said can with respect to said cam housing to eject a ball from said ball receiving recess into the interior of said pipe without opening said assembly to the atmosphere, ball positioning means inside said ball dropping can which cooperate with said ball receiving recess to restrict circumferential movement of said ball about said shaft in said can while allowing axial movement of said ball parallel to the longitudinal axis of said shaft; and wherein said ball positioning means comprises a cylindrical fitting having an internal bore for receiving said shaft and a side opening for receiving a portion of said ball.

* * * * *